US007726390B2

(12) United States Patent
Sucke et al.

(10) Patent No.: US 7,726,390 B2
(45) Date of Patent: Jun. 1, 2010

(54) HOLLOW CHAMBER PROFILE MADE OF METAL, ESPECIALLY FOR HEAT EXCHANGERS

(75) Inventors: Norbert William Sucke, Duisburg (DE); Ismail Boyraz, Bochum (DE); Reiner Breindl, Hattingen (DE); Reinhold Schurf, Velbert (DE)

(73) Assignee: Erbslöh Aluminium GmbH, Velbert (DE)

( * ) Notice: Subject to any disclaimer, the term of this patent is extended or adjusted under 35 U.S.C. 154(b) by 1449 days.

(21) Appl. No.: 10/516,852

(22) PCT Filed: Jun. 6, 2003

(86) PCT No.: PCT/EP03/05943

§ 371 (c)(1),
(2), (4) Date: Dec. 3, 2004

(87) PCT Pub. No.: WO03/104735

PCT Pub. Date: Dec. 18, 2003

(65) Prior Publication Data

US 2005/0161208 A1 Jul. 28, 2005

(30) Foreign Application Priority Data

Jun. 11, 2002 (DE) ..... 10225812
Jun. 11, 2002 (DE) ..... 20209005

(51) Int. Cl.
*F28F 1/08* (2006.01)

(52) U.S. Cl. ..... 165/177; 29/890.053

(58) Field of Classification Search ..... 165/177, 165/179

See application file for complete search history.

(56) References Cited

U.S. PATENT DOCUMENTS 1,481,312 A * 1/1924 Borgman ..... 165/177
1,830,412 A * 11/1931 Stark ..... 165/160
1,913,417 A 6/1933 Ulrich
2,270,864 A * 1/1942 Emilien ..... 165/79
2,819,731 A * 1/1958 Louthan ..... 138/38
3,119,446 A * 1/1964 Gerhart ..... 165/170
3,529,047 A * 9/1970 Arisawa et al. ..... 264/508

(Continued)

FOREIGN PATENT DOCUMENTS

DE 734100 A * 4/1943 ..... 165/177

(Continued)

OTHER PUBLICATIONS

Database WPI, Section PQ, Week 200112, Derwent Publications Ltd. London, GB & RU 2 155 921 C (Far E Poly), Sep. 10, 2000.

(Continued)

*Primary Examiner*—Allen J Flanigan
(74) *Attorney, Agent, or Firm*—Friedrich Kueffner

(57) ABSTRACT

The invention relates to a hollow chamber profile made of metal, especially for heat exchangers. Said profile is made of an extruded base profile (10) having two broad parallel sides and two narrow sides or is made of a base profile which is a circular tube type or coaxial tube type. At least one channel (11) extends inside said base profile in the longitudinal direction thereof. The hollow profile has improved heat transfer properties on the sides and webs (13) which are deformed perpendicular to the longitudinal direction thereof.

6 Claims, 4 Drawing Sheets

U.S. PATENT DOCUMENTS

| | | | | | |
|---|---|---|---|---|---|
| 3,596,495 | A | * | 8/1971 | Huggins | 72/370.18 |
| 3,692,889 | A | * | 9/1972 | Hetrich | 264/503 |
| 4,053,274 | A | * | 10/1977 | Lemelson | 425/381 |
| 4,953,632 | A | * | 9/1990 | Sakaya et al. | 165/104.26 |
| 5,181,560 | A | * | 1/1993 | Burn | 165/162 |
| 5,557,962 | A | | 9/1996 | Takikawa | |

FOREIGN PATENT DOCUMENTS

| | | |
|---|---|---|
| DE | 1053883 | 3/1959 |
| WO | 9425815 | 10/1994 |

OTHER PUBLICATIONS

Patent Abstracts of Japan, vol. 1995, No. 03, Apr. 28, 1995 & JP 06 344023 A (Kobe Steel Ltd), Dec. 20, 1994.

Patent Abstracts of Japan, vol. 0144, No. 50 (M-1030), Sep. 27, 1990 & JP 02 179313 A (Showa Alum Corp), Jul. 12, 1990.

* cited by examiner

FIG.1
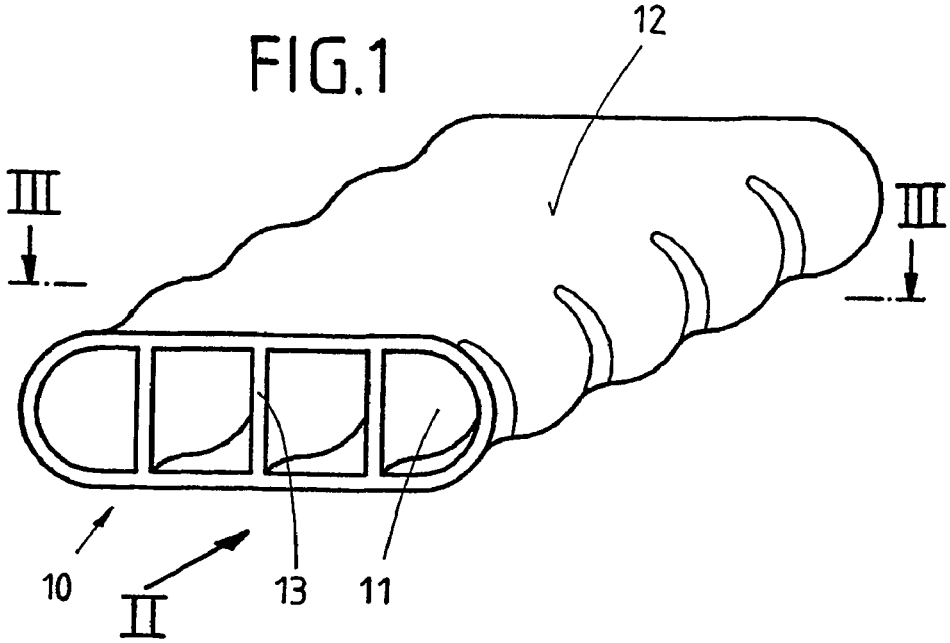
FIG.2
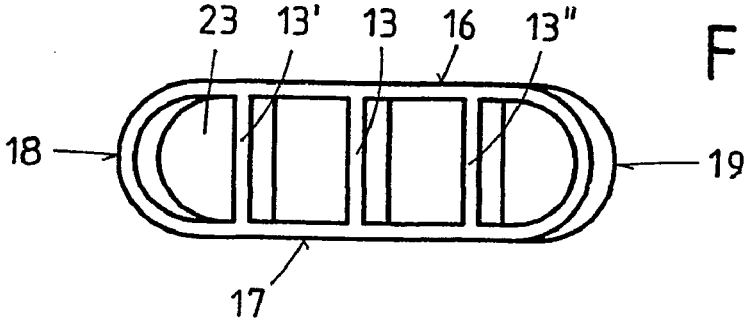
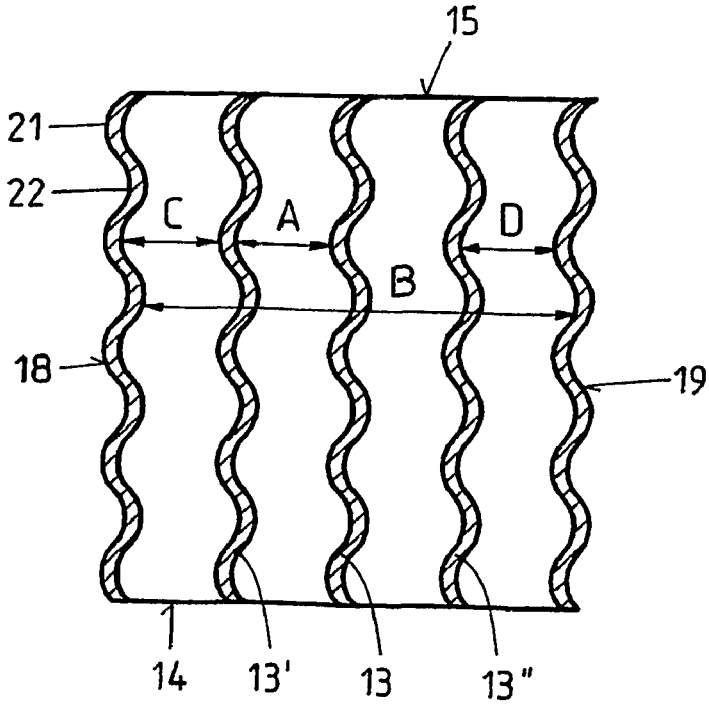
FIG.3

HOLLOW CHAMBER PROFILE MADE OF METAL, ESPECIALLY FOR HEAT EXCHANGERS

The invention pertains to a hollow-chamber profile made of metal especially for heat exchangers, consisting of an extruded base profile, which has the form of a hollow tube or coaxial tube or has two parallel wide sides and two narrow sides, where at least one channel extends longitudinally through the interior of the base profile.

This design of a hollow-chamber profile for heat exchangers is known from German Registered Design DE 94 06 559 U1. Here, a simple method by which the webs which form the channels are shaped during the extrusion process is described. The webs are profiled not after extrusion but during the extrusion process itself. For this purpose, the webs which are to be profiled with corrugations are supplied with more extrusion material than the webs which are not to be corrugated. This increased supply of material to be extruded leads to the upsetting of the material and thus to an intentional deformation of the extruded web. This therefore represents a simple method for increasing the surface area of the web, which leads to improved heat transfer. The intentional deformation of the webs, however, leads to the fact that the channel located between two of these deformed webs has a series of constricted and expanded sections distributed along the length of the profile. A variation of this type in the flow cross section leads to pressure losses and thus to a decrease in the heat-exchange output.

A cooler tube, furthermore, is known from DE 100 49 987 A1. This tube has ring-shaped corrugations at regular intervals, which project radially outward and are produced by the axial upsetting of the previously smooth cylindrical tube. Smooth cylindrical sections remain between the corrugations. A tube of this type, because of its increased outside surface area, has better heat transfer properties than a smooth tube. But because the free flow cross section is increased at the points of the tube where a ring-shaped corrugation is present, pressure losses occur in the medium flowing through the tube, and there is thus a loss of heat exchange performance in this case also. This tube also suffers from the disadvantage that the strength of the tube is affected by the axial compression performed as a follow-up operation.

Profiles of sheet aluminum shaped by rolls are used as an alternative to extruded aluminum tubes or multi-chamber hollow profiles. These profiles are often closed by high-frequency welding or by suitable shaping, followed by brazing. The heat-exchange properties can be improved by the use of turbulators. The disadvantage of this method is the high cost of producing and installing the turbulators. In addition, the brazed or welded tube seams are frequently a cause of failure under mechanical or corrosive stresses. The task can be accomplished only partially by the use of extruded aluminum profiles. Although the seams are much stronger, the suitability for heat exchange is limited by the tube walls and tube webs, which are shaped only in the extrusion direction. Optimal heat transfer cannot be achieved, especially in the case of gaseous media such as the air in charge coolers or the $CO_2$ or refrigerant gases used in air-conditioning heat exchangers.

The task of the invention is to make available hollow-chamber profiles, especially for heat exchangers, which have better heat-exchange properties than conventional extruded profiles and which can also be produced easily.

This task is accomplished according to the invention by a hollow-chamber profile of metal with the features cited in claim 1 or claim 5 and by a process according to claim 8.

The inventive hollow-chamber profile of metal, especially for a heat exchanger, is made from a base profile, which consists preferably of a corrosion-resistant, brazeable aluminum alloy such as a 1xxx, 3xxx, or 6xxx alloy. The extruded base profile has the form of a round tube or coaxial tube or the form of a flat tube with two parallel wide sides and two narrow sides, which connect the wide sides together. The interior space of the base profile is formed by at least one channel extending in the longitudinal direction. Opposite sides of the base profile are shaped in a direction perpendicular to its longitudinal orientation, where left-oriented profilings alternate with right-oriented profilings. These profilings are coordinated with each other in such a way that the width of the base profile remains the same over its entire length.

In the case of a profile in the form of a flat tube, this shaping, according to the invention, applies both to the narrow sides and to the webs which extend from wide side to wide side of the base profile to form several channels. In each case, the narrow sides and the webs are profiled in exactly the same way. This is achieved in that all the shaping operations are performed simultaneously and identically. If, for example, corrugations are to be provided down the length of the base profile, the left-oriented and right-oriented profilings will alternate with each other in the direction transverse to the longitudinal direction, so that the crests of the waves of the corrugations of the webs and of the two narrow sides engage in the corresponding valleys of the corrugations of the adjacent webs or narrow sides.

In the case of a tubular profile, especially a coaxial tube with several channels in the longitudinal direction, such shaping is provided both on the outside surface and on the webs which form the channels. In each case, here, too, the outside surface and the webs are profiled in exactly the same way.

It is preferable for the amplitudes of the corrugations of the shaped sides and of the webs to be of uniform height along the entire hollow-chamber profile; this also applies to the wavelengths of the profiling. To obtain high convection rates with good heat transfer at all points, however, it is not absolutely necessary for the corrugations to have the same wavelengths and the same amplitudes throughout. But if the wavelength or the amplitude of one such set of corrugations changes, this must also apply in the same way to the corrugations of the adjacent webs and also to the sides, so that there will never be a point at which two adjacent walls come closer to each other than they do at any other point. The shaping will therefore never change the flow cross section of the channels. The shaping does, however, create turbulence in the gas or liquid stream flowing through the profile. This turbulence is comparable to that produced by the known turbulators, which can also be used in such devices. A corrugated profile of this type can be used to increase the heat-exchange output of a gas or liquid stream, although the effect is usually less pronounced with liquids. A hollow-chamber profile of this type can be used advantageously as a cooler, especially as a $CO_2$ gas cooler, or as an aftercooler for motor vehicles.

The inventive hollow-chamber profile offers greater output than previously known extruded profiles with parallel webs and unshaped narrow sides, because better convection is achieved without any loss of the heat transfer performance attributable to the turbulence produced by the shaping of the webs and narrow sides transversely to the flow of gas or liquid.

A hollow-chamber profile of this type can be produced easily. In the first step of the process, a hollow profile strand, such as a round tube profile strand, a coaxial tube profile strand, or a flat tube profile strand with two parallel wide sides and curved or flat narrow sides is produced by extrusion so that at least one channel extends down the interior space of the base profile. The hot, hollow profile strand emerging from the shaping zone of the extruder is caused to oscillate in a defined manner by an oscillating shaping tool and is thus shaped. The shaped hollow profile strand can then be cut to the length desired for the hollow-chamber profile and can be provided, if desired, with stampings at the ends of the tubes. These stampings make it easier to push the tubes into the manifolds and also make it easier to braze the tubes together effectively to form a heat exchanger.

The hot, hollow profile strand emerging from the shaping zone is preferably subjected to the action of a shaping tool which oscillates in the direction perpendicular to the exit direction of the profile strand. At the same time, both the narrow sides of the flat tube profile or the outside surface of the round tube profile and any webs which may be present are shaped.

In a special embodiment, the shaping of the sides and of the webs consists of corrugations extending down the length of the base profile. The wavelength of a set of corrugations of this type preferably remains the same over the entire length of the hollow profile strand. This is achieved by adapting the oscillation frequency of the shaping tool to the exit speed of the hollow profile strand. During the production of multi-chamber hollow profiles, extrusion speeds of 15-200 m/minute, and preferably of 60-150 m/minute, are used. The wavelengths of the corrugations of the profile strand can be on the order of 1-100 mm.

The shaping of the flat tube profile strand, that is, its deflection, occurs preferably in the direction of the tube width, so that the wide sides retain their parallelism and are not deformed. This offers the advantage that the following steps of the process of fabricating heat exchangers, especially the connection to the cooling fins and manifolds, can be done very easily.

It is also possible, however, to control two different planes of oscillation separately from each other and thus to produce circular corrugations. This can be advantageous especially when round tube or coaxial tube profiles are being produced.

The oscillating movement of the shaping tool produces a deflection force transverse to the exit direction of the hollow profile strand. This deflection can be brought about by mechanical forces in the form of pressure and thrust. The hollow profile strand can also be deflected by electromagnetic forces. An especially reliable way of deflecting the hollow profile strand is to use a fluid medium to actuate the shaping tool. Air, nitrogen, or even water can be used here.

An essential aspect of the inventive process is that the hollow profile strand is shaped while it is hot. This can be achieved by locating the shaping tool in the immediate vicinity of the extrusion die. Thus the hollow profile strand cools down to only a negligible extent after it emerges from the extrusion die and before it is treated by the shaping tool. The temperature of the hollow profile strand in the shaping tool should be greater than 250° C., and preferably greater than 400° C., in order to arrive at the desired shape with little or no deformation. When the hot, hollow profile strand emerging from the extruder is now gripped and deflected by the oscillating shaping tool, the deflection forces act all the way back to the extruder die and influence the flow of material there. A shaping tool of this type can be located, for example, in a recess in the cross-brace of the extruder.

It is also conceivable, however, that the hollow profile strand emerging from the extruder die could be carried away from the extruder. In this case, it is advantageous to provide an appropriate device for guiding the profile strand between the extruder and the shaping device. Here, too, the high exit temperature of the hollow profile strand is used to make shaping possible without deformation. Nevertheless, it must be guaranteed that the hollow profile strand has the desired shaping temperature of more than 250° C. in the shaping tool.

In another embodiment of the inventive process, it is provided that the extruder die itself acts as an oscillating shaping tool. The extruder die or the components of the system or tools which position the die in the extruder perform an oscillating movement during the extrusion process.

The process according to the invention makes it possible to obtain hollow chamber profiles with corrugated shapes, where, in contrast to the state of the art, the corrugations in question can be produced in a defined manner; that is, the corrugations have reproducible amplitudes and/or wavelengths. As a result, a hollow chamber profile is produced which has the same free flow cross section and the same wall thicknesses at all points along the entire length of the profile. The heat-exchange surface is increased without causing significant pressure losses in the profile. At the same time, the laminar flow is disrupted by the corrugations. The turbulence thus created provides an advantageous increase in the heat-exchange output of the profile.

Additional features, advantages, and advantageous embodiments of the invention can be derived from the following description of the invention, which is based on the attached drawings:

FIG. 1 shows a perspective view of an inventive hollow-chamber profile;

FIG. 2 shows a cross section through the hollow-chamber profile of FIG. 1;

FIG. 3 shows a longitudinal section through the hollow-chamber profile along line III-III of FIG. 1;

Figure 4A:
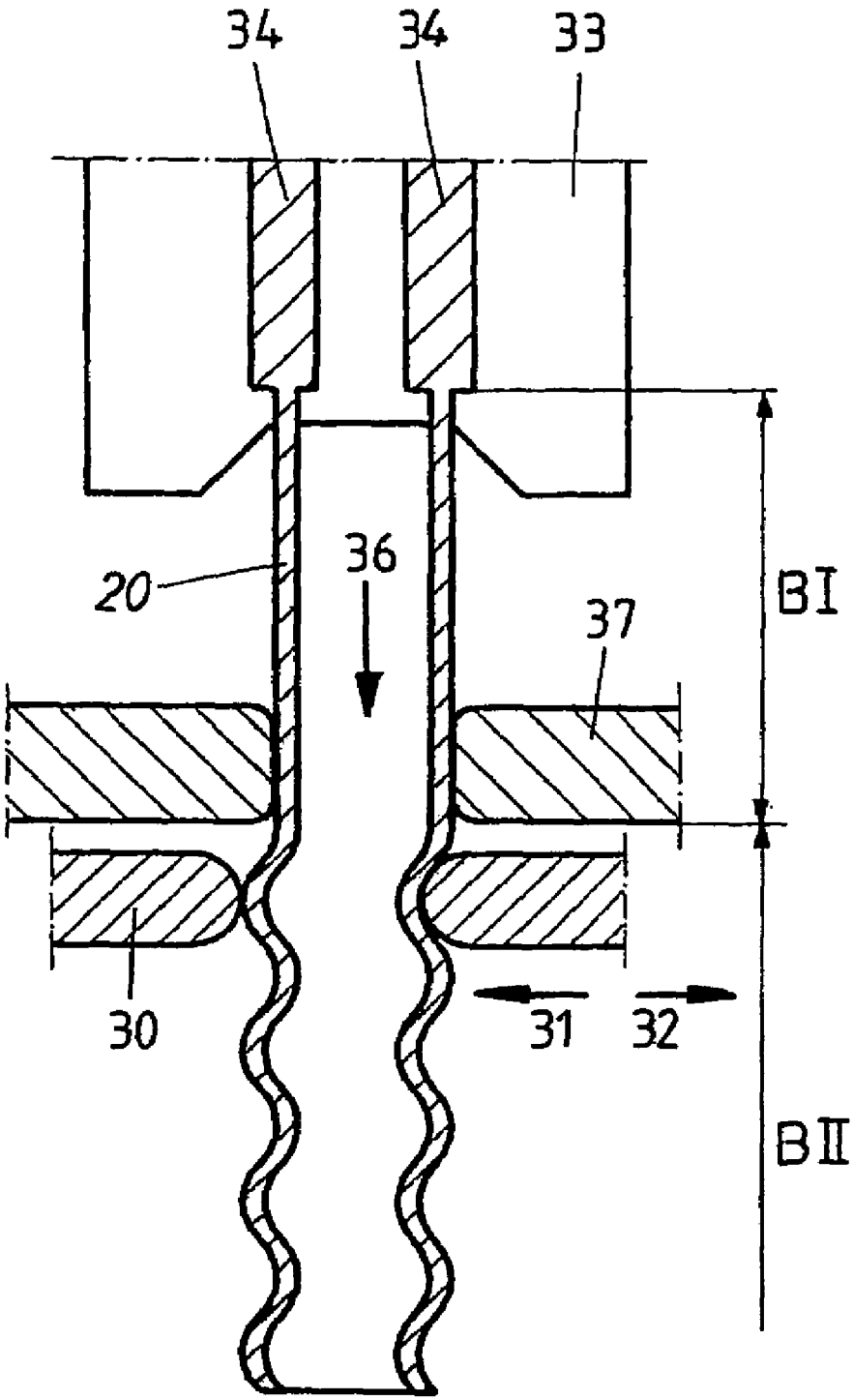
Figure 4B:
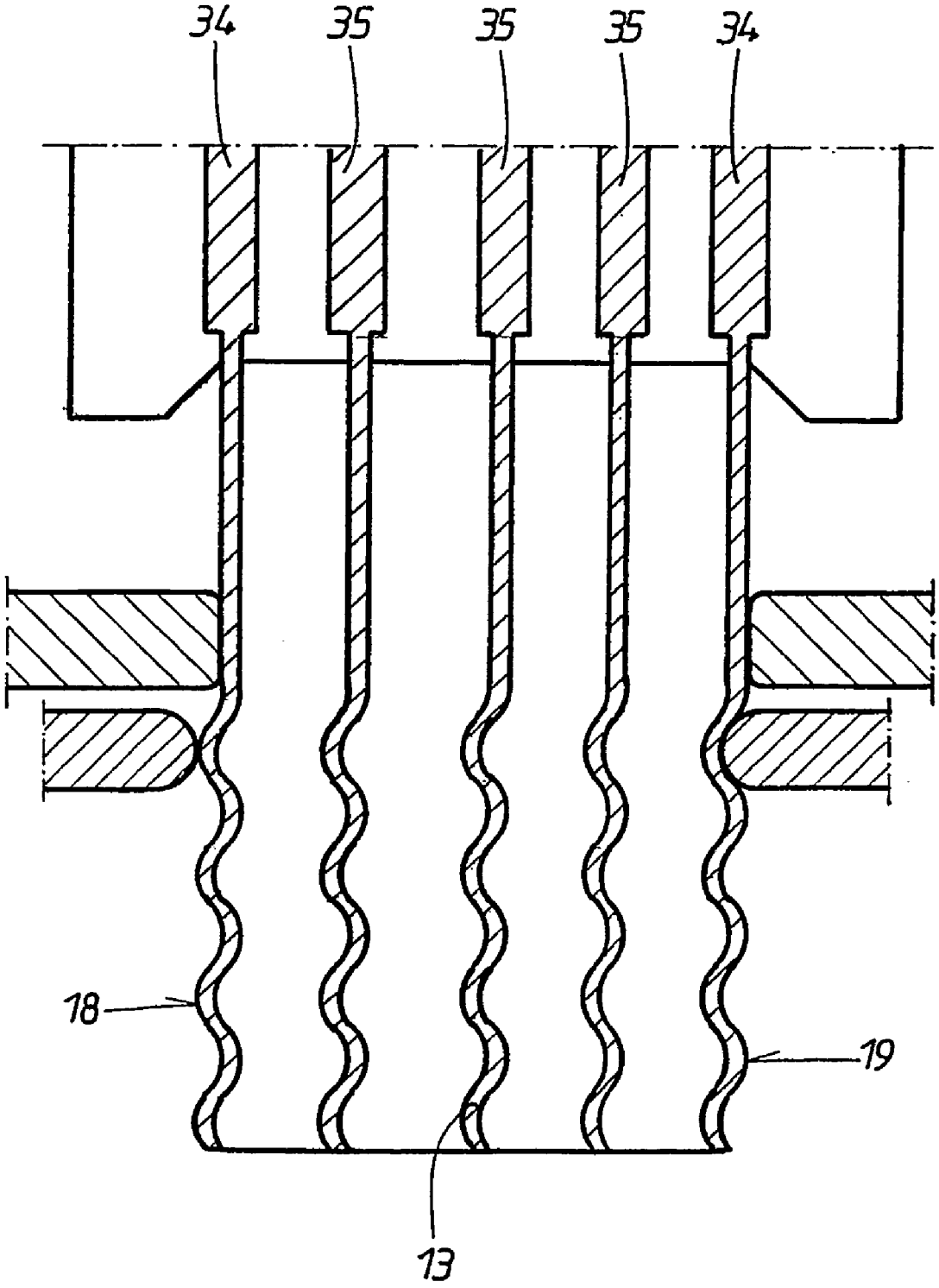
Figure 5:
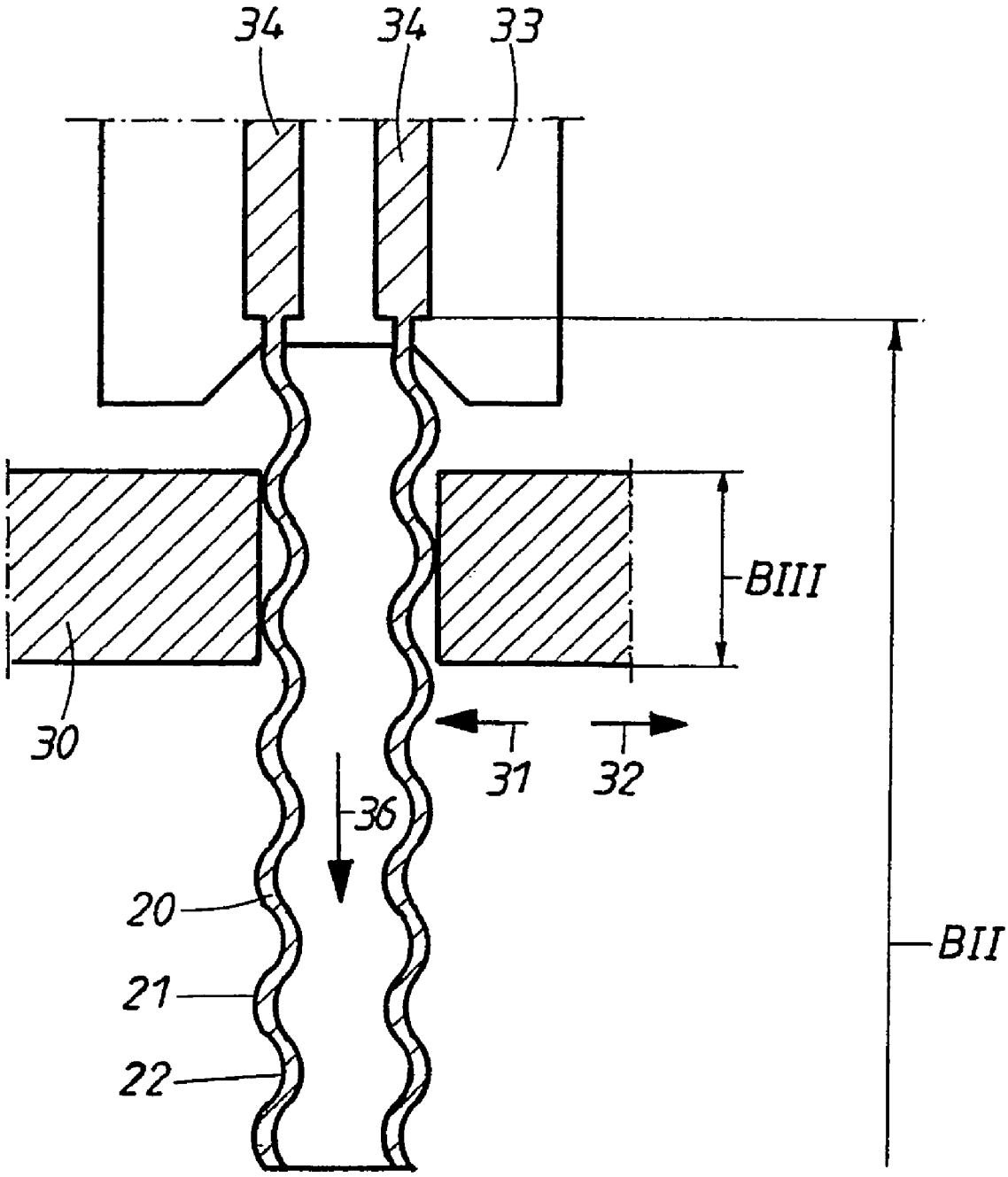

FIG. 4*a* shows a diagrammatic representation of an inventive process variant for a round tube profile;

FIG. 4*b* shows a diagrammatic representation of the inventive process variant according to FIG. 4*a* for a flat tube profile; and FIG. 5 shows a diagrammatic representation of another inventive process variant.

FIG. 1 shows an inventive hollow-chamber profile made of metal. It consists preferably of an extruded base profile 10 of light metal. This base profile 10 has at least one channel 11 oriented in the longitudinal direction of the base profile 10, and preferably several channels 11. These channels 11 are bounded by the wall 12 and by the webs 13. The base profile 10 can also have web extensions (not shown), which are located on the inside surfaces of the wall 12, extending into the channels 11 and parallel to the webs 13. As can be derived from FIGS. 1 and 2, the base profile 10 has two parallel wide sides 16, 17, which form the flat top and bottom of the profile. This is advantageous when the profile is to be used as a heat-exchanger profile. It facilitates installation and the connection of the cooling fins to the top and bottom of the base profile 10.

An inventive hollow-chamber profile can also have the form of a round tube or of a coaxial tube and have one or more channels oriented in the longitudinal direction of the profile.

The corrugations provided to increase the heat-exchange output of the profile pertain here exclusively to the narrow sides 18, 19 and to the webs 13. The narrow sides 18, 19 are shaped perpendicularly to the longitudinal orientation of the base profile, where left-oriented profilings 21 and right-oriented profilings 22 alternate with one another along the two narrow sides 18, 19 and also along the webs 13. As is especially clear in FIG. 3, the base profile 10 has a width B, which, in spite of the corrugations along each long side of the profile, is the same at all points. The reason for this is that the two narrow sides 18, 19 are profiled in the exactly same way; that is, they have exactly the same the wave-like pattern. The webs 13 also have the same wave-like pattern. At any two arbitrary points along the base profile 10, the distances A between the two adjacent webs 13 will always be the same. The distances C between the narrow side 18 and the first web 13' and the distances D between the narrow side 19 and the last web 13" are also constant. This means that any arbitrary cross section of the base profile 10 according to FIG. 1 has the same cross section as that according to FIG. 2; that is, the base profile 10 always has the same free flow cross section at all points in the longitudinal direction. In spite of the corrugations, it is therefore impossible for significant pressure losses to occur in the inventive base profile 10, because there are no resistances which could negatively affect the flow.

The narrow sides 18, 19 and the webs 13 of the base profile 10 shown in FIGS. 1 and 3 are advantageously shaped with sets of corrugations extending in the longitudinal direction, where the wavelengths of the various sets of corrugation remain uniform throughout. The profilings 21, 22 of the narrow sides 18, 19 and of the webs 13 also all have the same maximum deflection, that is, the same amplitude. A design of this type is not mandatory with respect to achieving a high heat-exchange output. As long as the free flow cross section remains constant, the wavelengths and/or amplitudes of the corrugations can also vary. The previously described embodiment, however, is easier to manufacture.

How an inventive hollow-chamber profile made of metal can be provided with defined, reproducible corrugations is described on the basis of two alternative embodiments of the process according to FIGS. 4*a* and 4*b* and FIG. 5.

A hollow profile strand 20 is produced by extrusion in the conventional manner. Only the extrusion die 33 of the extruder and its die chambers 34, 35 are shown in FIGS. 4*a*, 4*b*, and 5. The extruder can be a direct extruder known according to the state of the art, an indirect extruder, or an extruder for the conform process. The profile strand 20 with the desired profile shape is extruded in the exit direction 36 from the extrusion die 33. In the embodiment according to FIGS. 4*a* and 5, a round tube is obtained, and in the embodiment according to 4*b*, a flat tube profile with several channels 11 is obtained. In the conventional case, the hot, hollow profile strand 20 is sent along a cooling bed to various stations so that additional processes such as coating, shaping, or cutting to length can be carried out. In the device shown in FIGS. 4*a* and 4*b*, the hollow profile strand 20 has a straight profile strand section BI extending up as far as a guide 37. This straight profile strand section BI is followed by a shaped profile strand section BII. The shaping produces left-oriented profilings 21 and right-oriented profilings 22, which are produced by a shaping tool 30. This shaping tool 30 moves in the shift direction 31 to produce a left-oriented profiling 21 in the hollow profile strand 20 and then in the shift direction 32 to form a right-oriented profiling 22. The shaping tool 30 is an oscillator, which oscillates at a frequency f adapted to the extrusion speed and thus to the strand exit speed v in order to achieve the desired wavelength 1 for the hollow-chamber profile 10. The oscillation frequency f of the shaping tool 30 can be adjusted on the basis of the following formula:

$$F=v/1$$

where:

f=the oscillation frequency in Hz (1/s);

v=the strand exit speed in m/s; and l=the wavelength in m.

At a strand exit speed of 1 m/s (60 m/min) and a desired wavelength 1 of 0.005 m (5 mm), an oscillation frequency of f=200 Hz would be set for the shaping tool. The extrusion speeds v for hollow-chamber profiles, especially for MP profiles (multiport profiles) or MMP profiles (micro-multiport profiles) are in the range of 15-200 m/min, and preferably 60-150 m/min. The wavelengths 1 of the inventive corrugations are on the order of 1-100 mm.

The oscillating movement of the shaping tool 30, the force of which produces a deformation when it meets the hollow profile strand 20, can be realized in various ways. For example, a system operated by an electric motor or a cam drive can be used, or a hydraulic system can be used.

The hollow profile strand 30 could also be deflected by electromagnetic forces.

To achieve the desired shaping without deformation, the shaping temperature of the hollow profile strand 20 in the shaping tool 30 should be at least 250° C.; preferably, however, it should be more than 400° C. If, as a result of the layout of the production plant as a whole, the straight section BI of the profile strand is so long that the temperature of the hollow profile strand 20 drops significantly below 250° C., a heating device must be provided between the outlet of the extrusion die 33 and the shaping tool 30 to keep the hollow profile strand 20 at the desired shaping temperature in the shaping tool 30. If the length of the straight section BI of the profile strand is very short, there is no need to take measures to heat it.

FIG. 5 shows another diagram of a design of a device for an inventive process. A separate guide 37 is omitted here. The shaping tool 30 also assumes the function of guiding the hollow profile strand 20. In this case, however, the deflection forces, which are produced by the shaping tool 30 as it moves in the shift directions 31, 32, act all the way back to the die 33 and influence the flow of material there. In this case, the hollow profile strand 20 does not have any straight section BI after emerging from the die 33. Because the flow of the material of the hollow profile strand 20 is affected all the back to the shaping zone, the profilings 21, 22 are formed as soon as the strand emerges from the tool and are therefore already present in the area between the die 33 and the shaping tool 30. It is advantageous for the shaping tool 30 to have a width BIII in the exit direction 36 which is at least twice the wavelength 1 of the corrugated profilings.

A shaping tool 30 of this type, which represents an oscillating guide for the strand, is preferably mounted on the extruder itself. In particular, a shaping tool 30 of this type can be located and guided in a recess in the cross-brace of the extruder.

LIST OF REFERENCE NUMBERS

10 base profile
11 channel
12 wall
13, 13', 13" web
14 open end of 10
15 open end of 10
16 wide side
17 wide side
18 narrow side
19 narrow side
20 hollow profile strand
21 left-oriented profiling
22 right-oriented profiling
23 interior space
30 shaping tool/oscillator

31 shift direction
32 shift direction
33 extrusion die
34 die chamber
35 die chamber
36 exit direction of 20
37 guide
A distance between adjacent webs
B width of 10
BI straight section of the profile strand
BII shaped section of the profile strand
BIII width of 30
C distance between wide side 18 and web 13'
D distance between wide side 19 and web 13"

The invention claimed is:

1. Hollow-chamber profile made of metal, especially for heat exchangers, consisting of an extruded base profile (10) with two parallel wide sides (16, 17) and two narrow sides (18, 19), where at least one channel (11) extends in the longitudinal direction of the base profile (10) through the interior space (23) in the base profile (10), wherein the narrow sides (18, 19) are shaped in the direction perpendicular to the longitudinal dimension of the base profile (10), where left-oriented profilings (21) transverse to the longitudinal dimension and right-oriented profilings (22) transverse to the longitudinal dimension alternate with each other along the two narrow sides (18, 19), and where the width (B) of the base profile (10) is the same over the entire length of the base profile (10), the narrow sides with the profilings have a uniform wall thickness along the entire length of the profile.

2. Hollow-chamber profile according to claim 1, wherein webs (13), which extend from wide side (16) to wide side (17) and form several channels (11), are located in the interior space (23) of the base profile (10), and in that these webs (13) have profilings (21, 22) perpendicular to the longitudinal dimension of the base profile (10), where the distance (A) between two adjacent webs (13), the distance (C) between the narrow side (18) and the first web (13'), and the distance (D) between the narrow side (19) and the last web (13') are the same over the entire length of the base profile (10).

3. Hollow-chamber profile according to claim 2, wherein the profilings (21, 22) of the narrow sides (18, 19) and of the webs (13) form a wave-like pattern extending down the length of the base profile (10), such that the base profile (10) has the same free flow cross section at all points along its length.

4. Hollow-chamber profile according to claim 3, wherein the wavelike patterns formed by the narrow sides (18, 19) and the webs (13) have the same wavelength over the entire length of the base profile (10).

5. Hollow-chamber profile according to claim 1, wherein the base profile (10) is manufactured of aluminum or an aluminum alloy.

6. Hollow-chamber profile according to claim 1, wherein it is used as a cooler for gas or liquid streams, especially as a gas cooler or as a charge cooler for motor vehicles.

* * * * *